US008347432B2

(12) United States Patent
Schmid et al.

(10) Patent No.: US 8,347,432 B2
(45) Date of Patent: Jan. 8, 2013

(54) ONE-PIECE BLANKET SWADDLE

(75) Inventors: William R. Schmid, Plymouth, MN (US); Dawn Griffin, Wayzata, MN (US)

(73) Assignee: Halo Innovations, Inc., Minnetonka, MN (US)

( * ) Notice: Subject to any disclaimer, the term of this patent is extended or adjusted under 35 U.S.C. 154(b) by 7 days.

(21) Appl. No.: 13/132,411

(22) PCT Filed: Dec. 2, 2009

(86) PCT No.: PCT/US2009/066368

§ 371 (c)(1),
(2), (4) Date: Jun. 2, 2011

(87) PCT Pub. No.: WO2010/065610

PCT Pub. Date: Jun. 10, 2010

(65) Prior Publication Data

US 2011/0231993 A1 Sep. 29, 2011

Related U.S. Application Data

(60) Provisional application No. 61/119,930, filed on Dec. 4, 2008.

(51) Int. Cl.
*A47G 9/06* (2006.01)

(52) U.S. Cl. ..... 5/494; 5/655; 5/413 R

(58) Field of Classification Search ..... 5/494, 655, 5/413 R; 2/69.5

See application file for complete search history.

(56) References Cited

U.S. PATENT DOCUMENTS

| | | | | |
|---|---|---|---|---|
| 5,046,204 | A * | 9/1991 | Mohler | 5/413 R |
| 5,722,094 | A | 3/1998 | Ruefer | |
| 6,272,888 | B1 | 8/2001 | Fujita et al. | |
| 6,341,397 | B1 * | 1/2002 | Kliegl et al. | 5/482 |
| 6,640,340 | B2 * | 11/2003 | Gibson | 2/69.5 |
| 6,839,924 | B2 * | 1/2005 | Sims | 5/494 |
| 6,928,674 | B2 * | 8/2005 | Blackburn | 5/482 |
| 6,948,200 | B2 * | 9/2005 | Wyman | 5/494 |
| 7,181,789 | B2 * | 2/2007 | Gatten | 5/494 |
| 7,246,392 | B2 | 7/2007 | Schmid et al. | |
| 7,774,875 | B1 * | 8/2010 | Zeidman | 5/494 |

FOREIGN PATENT DOCUMENTS

| | | |
|---|---|---|
| JP | 3070302 | 5/2000 |
| WO | WO2006/055010 | 5/2006 |

OTHER PUBLICATIONS

U.S. Appl. No. 11/820,364, filed Jun. 19, 2007, Entitled: "Garment With Individual Care Information", William Schmid et al.

* cited by examiner

*Primary Examiner* — Michael Trettel
(74) *Attorney, Agent, or Firm* — Hamre, Schumann, Mueller & Larson, P.C.

(57) ABSTRACT

An infant swaddle blanket that includes a torso wrap section with wings and a leg pouch for the infant's legs. The torso wrap section is designed to wrap around the infant's torso for swaddling. The swaddle includes various hook and loop fasteners which facilitates swaddling and makes the swaddle easier to use, as well as making the swaddle safer to use by providing a more secure, adjustable fit. External hold-down straps augment hook and loop closures on the wings. The leg pouch permits the infant's diaper to be changed without unwrapping the torso wrap section, thereby facilitating diaper changes.

8 Claims, 8 Drawing Sheets

ONE-PIECE BLANKET SWADDLE

This application claims the benefit of International Application Serial No. PCT/US2009/066368, filed on Dec. 2, 2009 and U.S. Provisional Application Ser. No. 61/119,930, filed on Dec. 4, 2008, the entire contents of which are incorporated herein by reference.

FIELD

This disclosure describes a blanket swaddle for use in swaddling an infant.

BACKGROUND

There are many benefits to swaddling an infant, particularly with the advent of the supine sleep position which is encouraged as a means to reduce the risk of Sudden Infant Death Syndrome (SIDS). Swaddling, which is wrapping or binding around an infant, has traditionally been practiced using a blanket or strips of cloth which are tightly wrapped around the infant. Most infants who sleep in the supine position startle more easily (referred to as Moro reflex) and sleep for shorter durations of time. Swaddling an infant has been shown to increase sleep duration with fewer awakenings.

There are, however, risks to swaddling. If swaddled improperly, an infant can easily work out of the swaddle, creating a loose blanket which has been shown to increase the risk of SIDS or strangulation. If they do not completely free themselves, the swaddle may migrate over their face, creating an equally dangerous situation. Even the best-swaddled infants will eventually free themselves as they get older. Further, if bound too tight, a swaddle can inhibit chest wall movement, compromising an infant's ability to breathe normally. In addition, if the swaddle binds the infant's legs preventing them from flexing and abducting normally, this may lead to the development of hip dysplasia.

SUMMARY

An improved one-piece blanket swaddle is described that makes swaddling an infant easier, safer and more convenient for a caregiver.

The swaddle includes a leg pouch at the base thereof for receiving the infant's legs. The swaddle also includes a torso wrap section with wings for wrapping around the infant's torso.

The swaddle is made from a low-stretch material, for example cotton or fleece, suitable for use in blankets. The swaddle includes hook and loop fasteners which facilitates swaddling and makes the swaddle easier to use.

In addition, the swaddle is safer to use by providing two levels of hook and loop fasteners for a more secure, adjustable fit. External hold-down straps augment hook and loop closures on the wings. A common problem with conventional swaddles that use hook and loop fasteners is that babies can break out of them too easily, which increases the risk of entanglement or suffocation of the baby by the loose swaddle. Thus, many conventional swaddles are less secure, and when broken out of, even dangerous.

The leg pouch at the base of the swaddle is fastenable to the outside surface of the top layer on the swaddle wings. With the disclosed swaddle, the infant's diaper can be changed without unwrapping the swaddle, thereby facilitating diaper changes.

DRAWINGS

DETAILED DESCRIPTION

Figure 1:
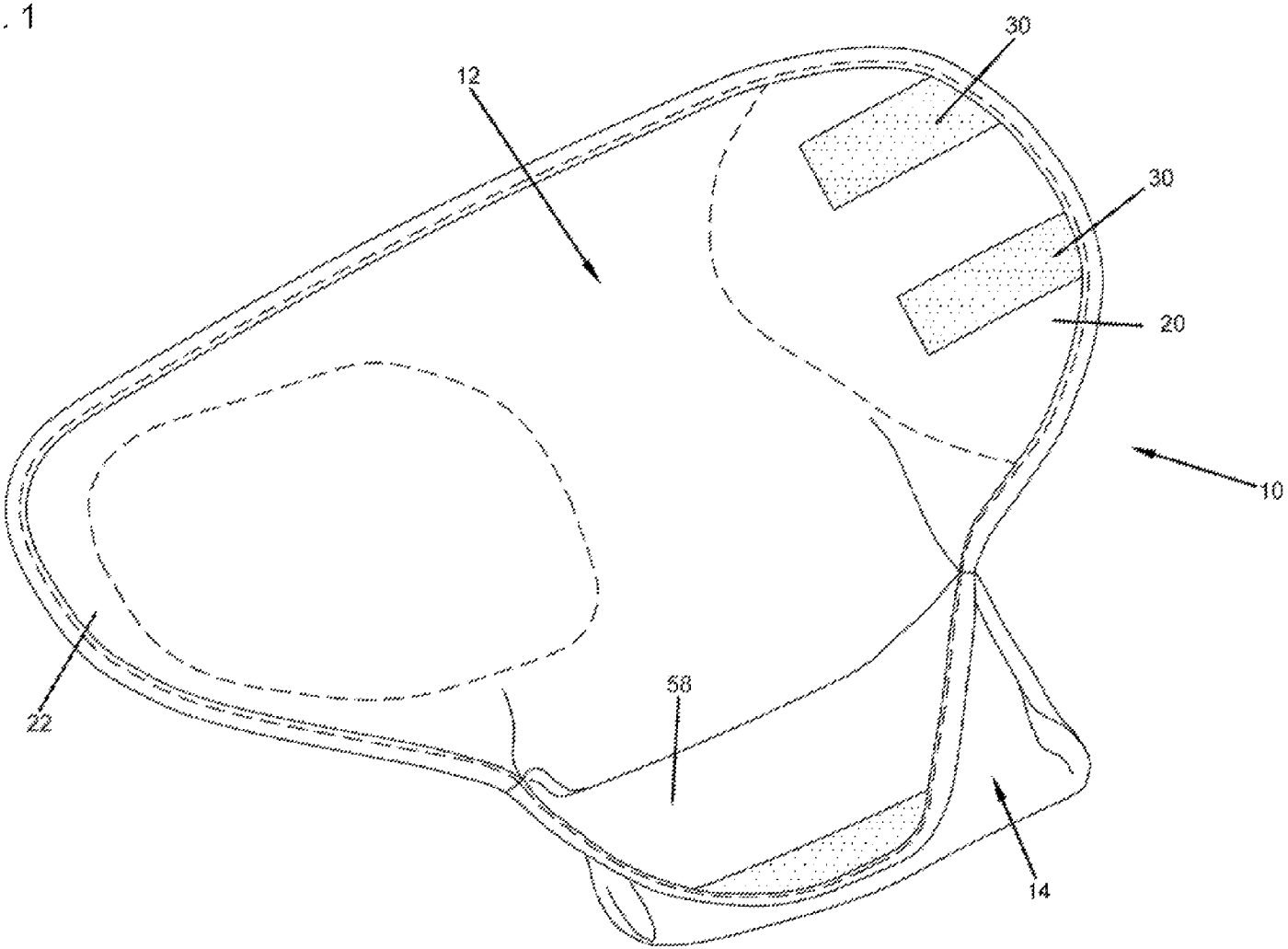
FIG. 1 is a perspective view of the one-piece blanket swaddle.
Figure 2:
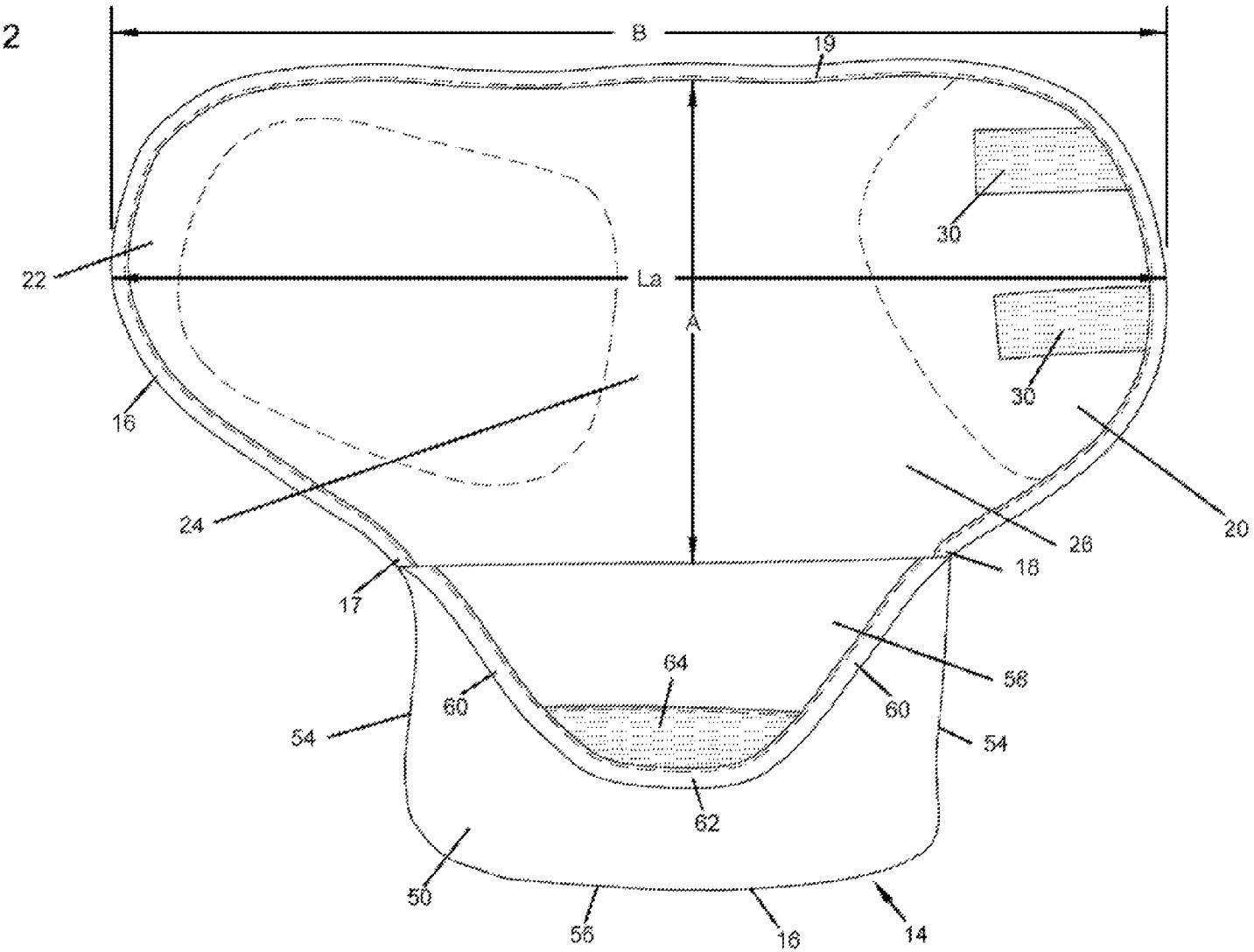
FIG. 2 is a front view of the swaddle.
Figure 3:
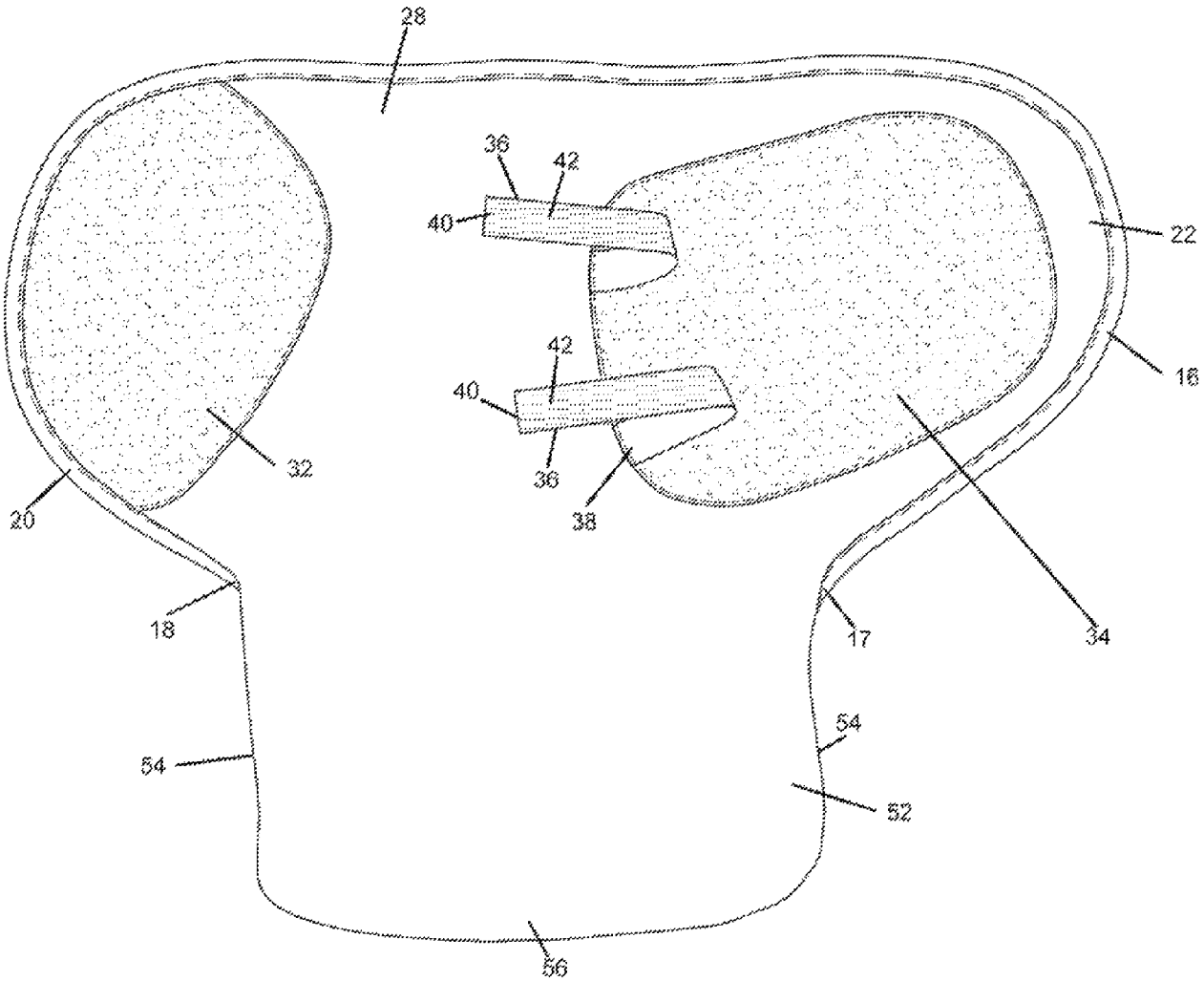
FIG. 3 is a rear view of the swaddle.

With reference to FIGS. 1-3, a one-piece blanket swaddle 10 is illustrated. The swaddle 10 generally includes a torso wrap section 12 and a leg pouch 14. The torso wrap section 12 and the leg pouch 14 are integrally formed as a one-piece construction so that the swaddle 10 can be characterized as one-piece, even though the swaddle 10 has different sections. The torso wrap section 12 is formed without arm holes therein because the infant's arms are intended to be wrapped in the swaddle.

The swaddle 10 is made from any material suitable for use in swaddling an infant while providing warmth to the infant. Examples of suitable materials include cotton and fleece. The material used is preferably low-stretch material. A knit or woven cotton or polyester fleece are examples of suitable low-stretch materials. The swaddle 10 may be made from one layer of fabric.

With reference to FIG. 2, the torso wrap section 12 is generally in the shape of an elongated oval having a longitudinal axis La with a maximum length dimension B and a maximum height dimension A. The dimension B is selected to fully wrap an infant that fits the size, while the dimension A is selected to the length of a typical baby for that size. For example, for a newborn infant, the dimensions of B and A can be about 26 inches and about 12 inches, respectively. Preferably, the maximum height A is chosen such that the section 12 will primarily cover the torso and arms of the infant, leaving the infant's legs free to flex within the leg pouch 14. The dimension B is chosen such that the section 12 is long enough to fully and securely wrap the infant.

The torso wrap section 12 includes a perimeter edge 16 that extends from one juncture 17 with the leg pouch 14 to a second juncture 18 with the leg pouch 14. Included in the perimeter edge 16 is a top edge 19 that forms the uppermost edge of the swaddle 10. The leg pouch 14 has an outer perimeter 16' extending from the juncture 17 to the juncture 18.

The section 12 has rounded wings 20, 22 and a central portion 24 between the wings 20, 22 with the maximum height A. The perimeter edge 16 of the wings 20, 22 extends beyond the perimeter 16' of the leg pouch 14. The section 12 also includes an inner surface 26 (i.e. the surface that in use faces the infant) and an outer surface 28 (i.e. the surface that in use faces away from the infant). As illustrated in FIG. 2, one of the wings 20 or 22 is larger than the other wing. In the illustrated embodiment, the wing 22 is larger than the wing 20.

The swaddle comprises a means for attaching the first wing 20 to the second wing 22 to secure the wings around the infant's torso. For example the means for attaching may include snaps, magnets, buttons, and hook and loop materials. Each wing may have one or more fastening means. As illustrated in FIG. 2, the wing 20 includes a pair of hook patches 30 disposed on the inner surface 26 near the perimeter edge 16 of the wing 20. The hook patches 30 are spaced apart from each other to help maximize securement of the swaddle. The first wing 20 is not limited to a pair of hook patches and may have any number of hook patches so long as the wing 20 is capable of securing the infant inside the torso wrap section.

With reference to FIG. 3, the wing 20 also includes a large loop patch 32 disposed on the outer surface 28 near the perimeter edge 16. The patch 32 extends generally from the top edge 19 downwards to near the juncture 18 and extends inwardly from the perimeter edge 16 toward the central portion 24. The large surface area of the patch 32 maximizes the chances of a corresponding hook patch engaging the patch 32 to ensure securement, and accounts for misalignment during swaddling.

With continued reference to FIG. 3, the wing 22 includes a large loop patch 34 disposed on the outer surface 28 near the perimeter edge 16. In the illustrated embodiment, the patch 34 is spaced from the edge 16, but the patch 34 could extend all the way to the edge if desired. The patch 34 extends generally from near the top edge 19 downwards to near the juncture 17 and extends inwardly from near the perimeter edge 16 toward the central portion 24. The large surface area of the patch 34 maximizes the chances of a corresponding hook patch engaging the patch 34 to ensure securement, and accounts for misalignment during swaddling.

Figure 5:
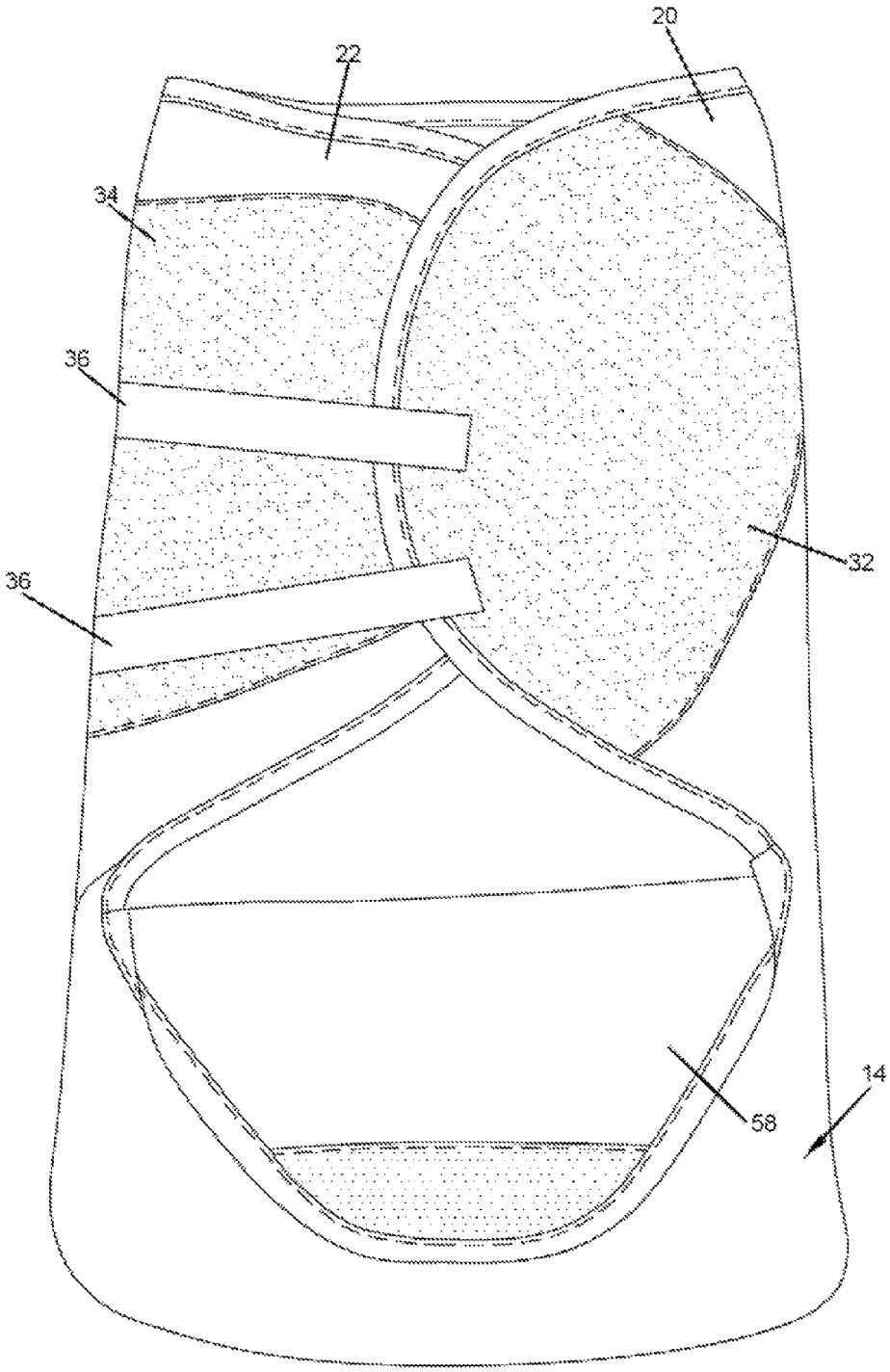
FIG. 5 shows a second exemplary step of using the swaddle.

An additional means of securing the wings 20 and 22 together may be added to the torso wrap section. For example, a pair of hold down straps 36 are disposed on the outer surface 28. The straps 36 augment the securement provided by the hook and loop patches 30 and 34. Each strap 36 may be rectangular in shape with one end 38 secured generally at the central portion 24. In the illustrated embodiment, the ends 38 are secured at the inward edge of the patch 34. Each strap 36 also includes a second end 40, with the strap between the ends 38, 40 not being secured to the swaddle 10. The straps 36 include inward facing surfaces (i.e. surfaces that in use as shown in FIG. 5 face toward the infant) that are provided over the majority of their lengths with hook fastener patches 42. The straps 36 are spaced apart from each other to help maximize securement of the swaddle, and are intended to be secured to the patch 32.

Returning to FIGS. 1 and 2, the leg pouch 14 extends from the base of the torso wrap section 12. The pouch 14 comprises a front panel 50 positioned on the front side of the swaddle 10, and rear panel 52 (see FIG. 3) positioned on the rear side of the swaddle. The panels 50, 52 are secured to each other along side edges 54 and a bottom edge 56 of the leg pouch 14 to create a pouch for receiving the infant's legs. The room provided in the pouch is sufficient to allow the infant's legs to flex and abduct normally.

The front panel 50 may also include a front flap 58 integrally formed therewith. As shown in FIG. 2, the flap 58 is sized so that it can overhang the outer surface of the front panel 50, with the flap 58 tapering in width so that side edges 60 of the flap converge toward a terminal edge 62. The outer surface (when viewing FIG. 2) of the flap 58 includes a means for releasable engagement with the torso wrap section 12. For example, the flap may include a means such as hook patch 64 near the terminal edge 62 that extends between the side edges 60. The hook patch 64 is capable of attaching to the loop patch 34 and 32 on the torso wrap section 12.

Figure 4:
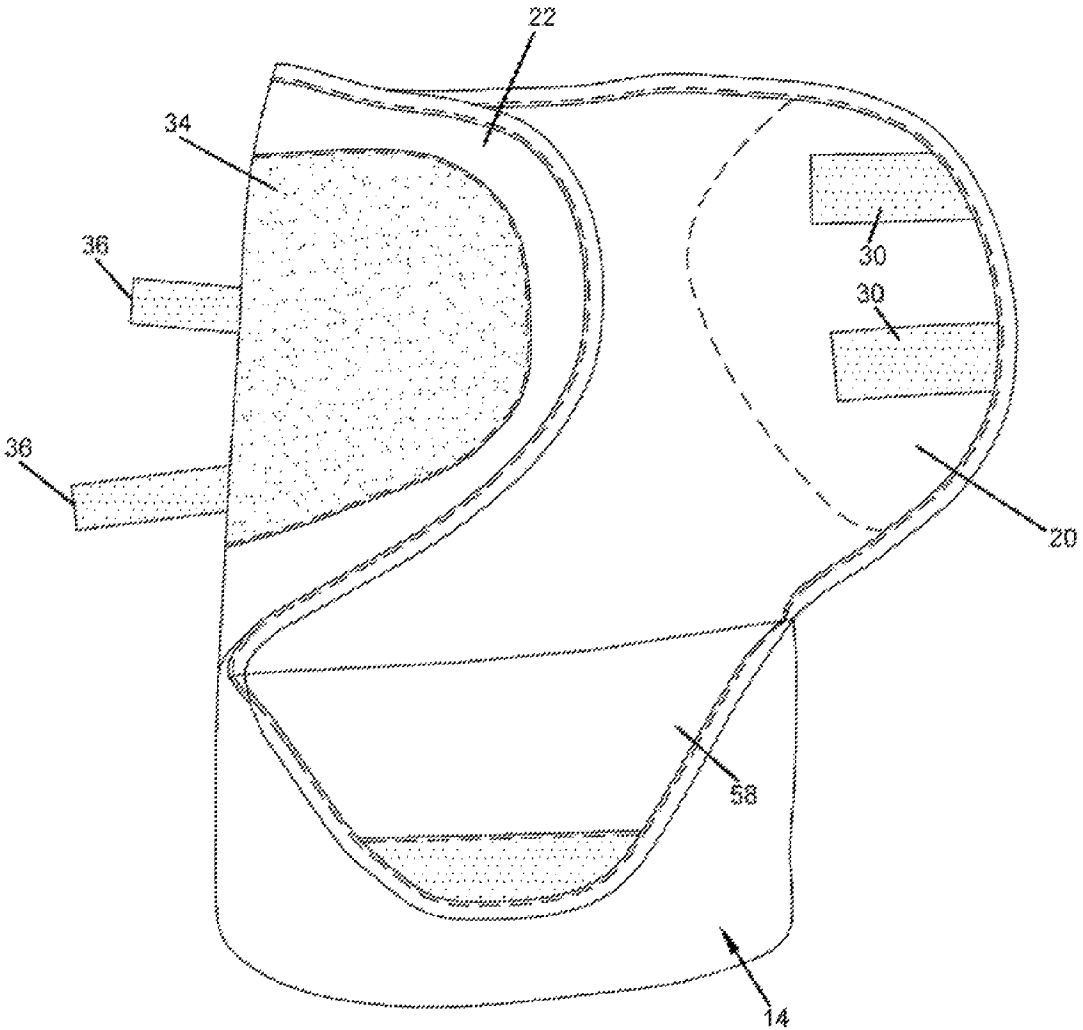
FIG. 4 is a front view of the swaddle in a first exemplary step of using the swaddle.
Figure 6:
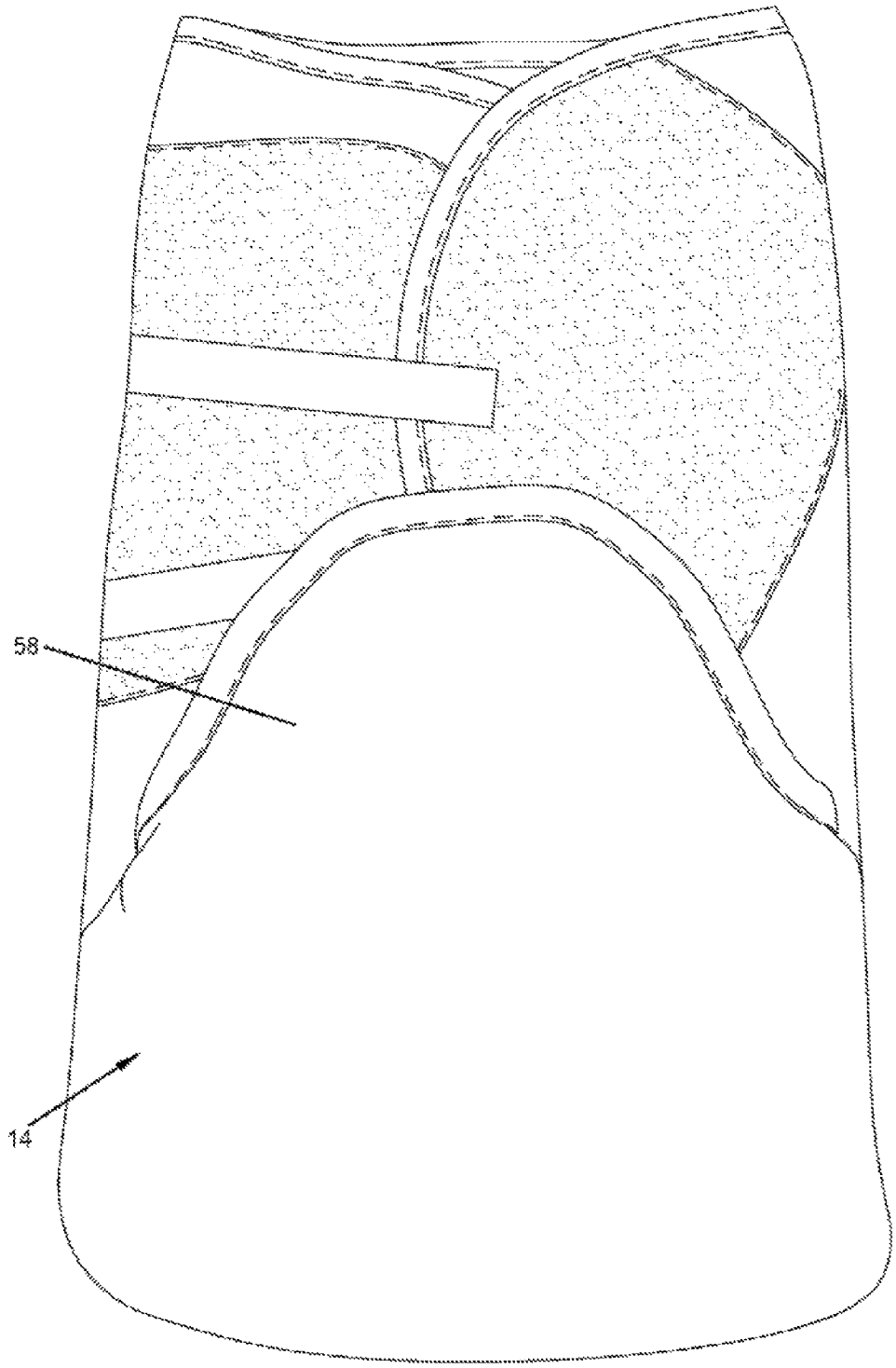
FIG. 6 shows a third exemplary step of using the swaddle.
Figure 7:
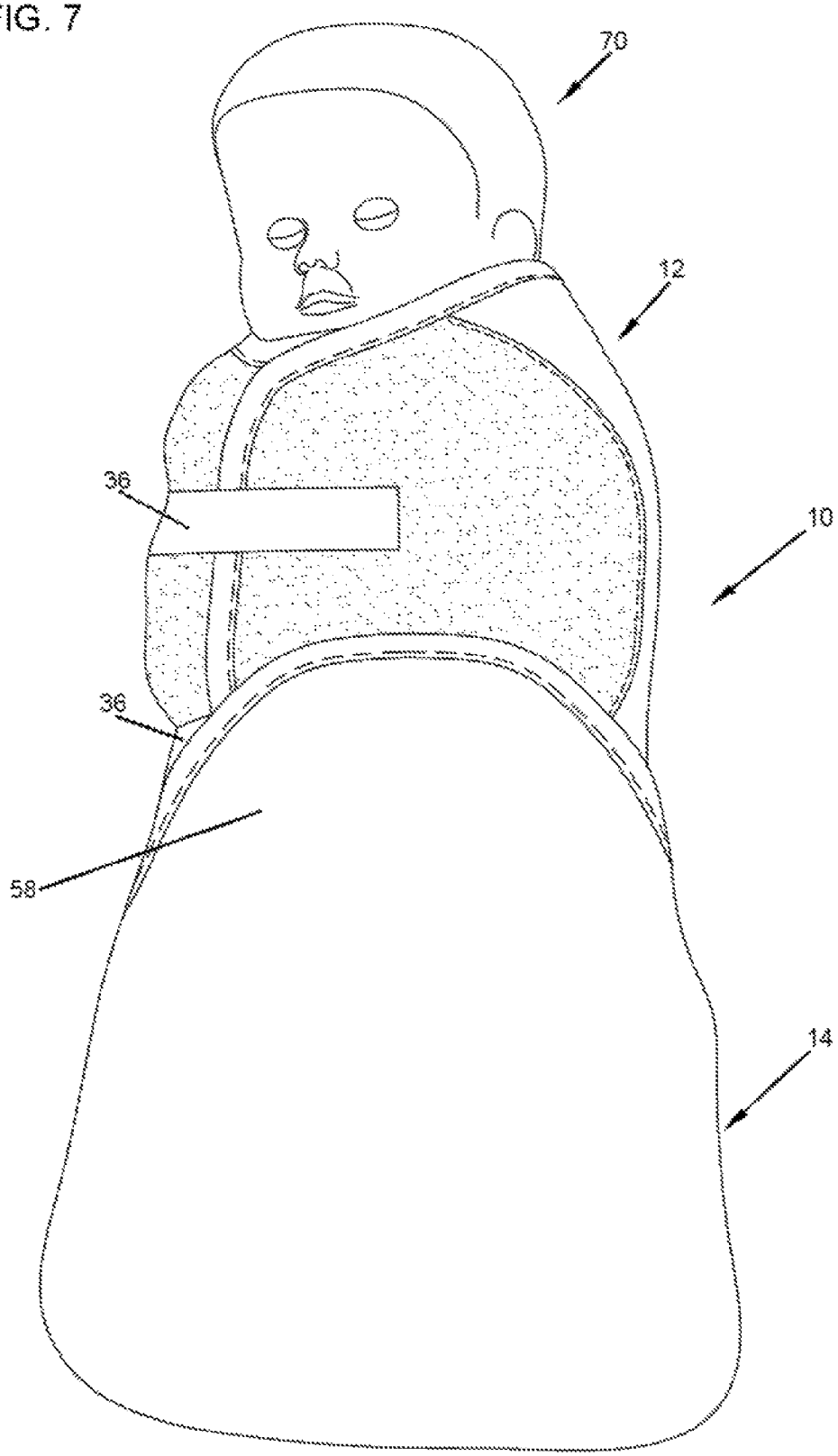
FIG. 7 shows an infant wrapped in the swaddle.

Operation of the swaddle 10 will now be described with reference to FIGS. 4-7. First, FIG. 7 illustrates an infant 70 wrapped in the swaddle 10, with the swaddle fully secured. To begin swaddling, the swaddle can be laid out as illustrated in FIG. 2 on a flat surface. The infant 70 is then laid on the swaddle with the infant's legs either within or outside of the pouch 14. The wing 22 is then folded over the infant as depicted in FIG. 4, which makes the loop patch 34 now face upward. Next, the wing 20 is then folded over the top of the wing 22 as depicted in FIG. 5, with the hook patches 30 being fastened to the loop patch 34. The loop patch 32 on the wing 20 is now exposed and faces upward. The straps 36 are then secured in place by connecting the hook patches 42 to the loop patch 32 on the wing 20. The infant's legs are then placed in the pouch 14 if not already in the pouch, and the flap 58 is folded upwardly so that the hook patch 64 thereof engages with the loop patches 32 and 34 to close off the pouch as shown in FIG. 6.

Figure 8:
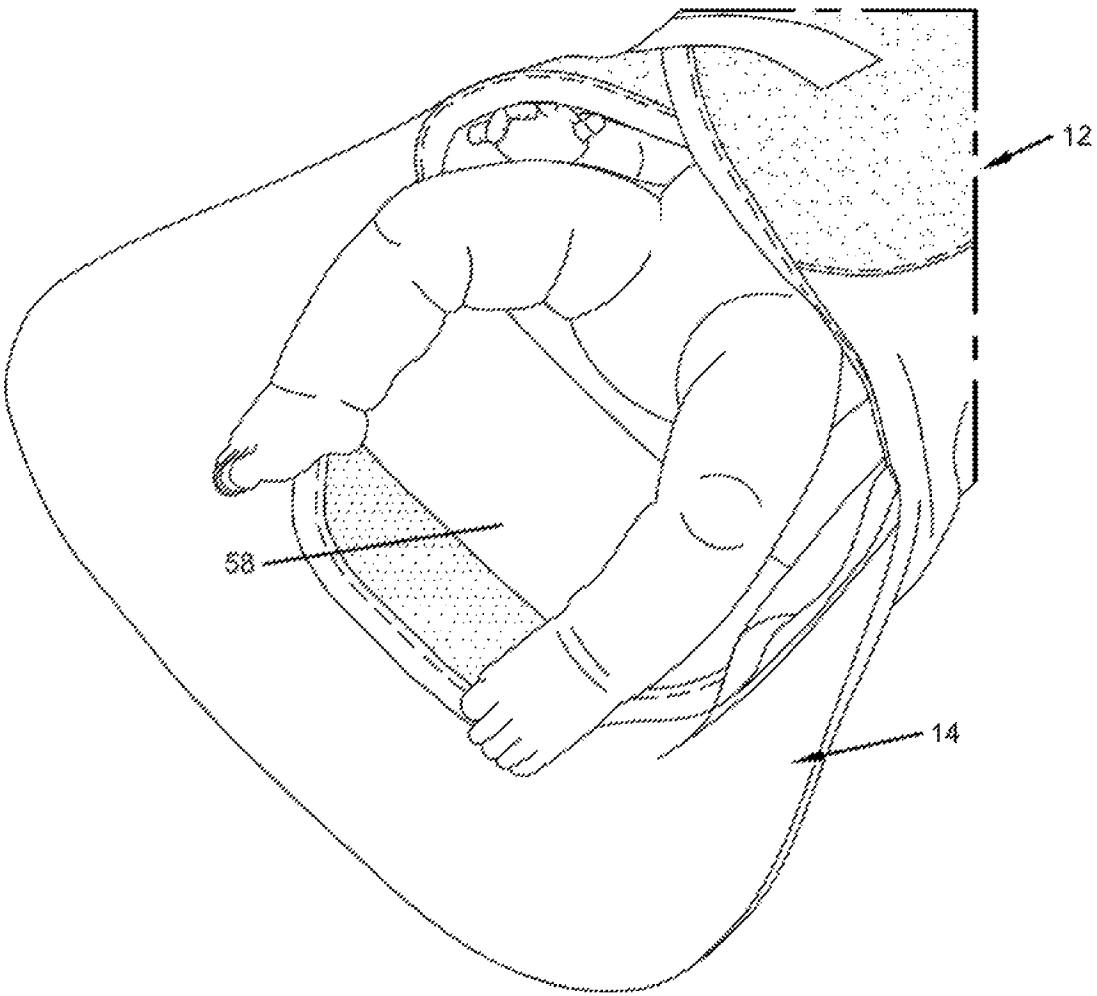
FIG. 8 illustrates a diaper change without unwrapping the swaddle.

As evident from FIG. 7, the infant's body below the head is encased in the swaddle 10, so that the swaddle functions as a blanket keeping the infant warm. The swaddle is designed to allow the infant's diaper to be changed without unwrapping the torso wrap section 12 of the swaddle, thereby facilitating diaper changes. This can be seen in FIG. 8 which shows the flap 58 disengaged from the torso wrap section 12 and folded back down over the front panel 50 of the pouch 14. This provides access to the infant's lower region and legs, and the legs are removed from inside the pouch 14. The diaper can then be changed while the swaddle effect of the torso wrap region 12 is maintained. Once the diaper change is complete, the infant's legs can be placed back inside the pouch, and the flap 58 folded upwardly to engage with the torso wrap section 12.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. An infant swaddle blanket, comprising:

a torso wrap section having an inside surface and an outside surface, a first wing and a second wing, a central portion located between the first and second wings and a means for securing the first and second wings together;

a leg pouch integrally formed with the torso wrap section, the leg pouch comprising a front panel and a rear panel wherein the front panel is attached to the rear panel to form an interior space; and the means for securing the first and second wings together comprises a pair of hook patches on an inner surface of the first wing and a loop patch on an outer surface of the second wing and at least one strap connected to the outside surface of the torso wrap section and configured to attach to the first wing.

2. The infant swaddle blanket of claim 1 wherein the torso wrap section and the leg pouch are comprised of one layer of fabric.

3. The infant swaddle blanket of claim 1 wherein the torso wrap section has a perimeter edge, the leg pouch has a perimeter edge; and the perimeter edge of the torso wrap section projects beyond the perimeter edge of the leg pouch.

4. The infant swaddle blanket of claim 1 wherein the second wing is larger than the first wing.

5. The infant swaddle blanket of claim 1 wherein the first wing includes a loop patch on an outer surface thereof, and the strap includes a hook patch that is engageable with the loop patch of the first wing.

6. The infant swaddle blanket of claim 1, wherein the leg pouch further comprises a flap that is integrally formed with the front panel and configured for releasable engagement with the torso wrap section.

7. The infant swaddle blanket of claim 6 wherein, the flap has a hook patch that engages a loop patch on the outside surface of the torso wrap section.

8. An infant swaddle blanket, comprising:

a torso wrap section having an inside surface and an outside surface, a first wing and a second wing, a central portion located between the first and second wings and a means for securing the first and second wings together;

a leg pouch integrally formed with the torso wrap section, the leg pouch comprising a front panel and a rear panel wherein the front panel is attached to the rear panel to form an interior space; and the torso wrap section includes a pair of straps that are connected to the outside surface of the torso wrap section and that extend over a loop patch on an outer surface of the second wing, the straps include a hook patch that is engageable with a loop patch on an outer surface of the first wing.

* * * * *